US006698085B2

(12) United States Patent
Stevenson et al.

(10) Patent No.: US 6,698,085 B2
(45) Date of Patent: Mar. 2, 2004

(54) METHOD FOR MANUFACTURING LOW COST ELECTROLUMINESCENT (EL) ILLUMINATED MEMBRANE SWITCHES

(75) Inventors: William C. Stevenson, Santa Ana, CA (US); James L. Lau, Santa Ana, CA (US)

(73) Assignee: Novatech Electro-Luminescent, Inc., Chino, CA (US)

( * ) Notice: Subject to any disclaimer, the term of this patent is extended or adjusted under 35 U.S.C. 154(b) by 129 days.

(21) Appl. No.: 09/942,339

(22) Filed: Aug. 30, 2001

(65) Prior Publication Data

US 2003/0041443 A1 Mar. 6, 2003

(51) Int. Cl.[7] ..... H01H 11/00; H01H 11/02; H01H 11/04; H01H 65/00

(52) U.S. Cl. ..... 29/622; 29/846; 29/847; 216/13

(58) Field of Search ..... 29/622, 846, 847; 216/13, 12, 5; 438/5; 313/506, 509; 427/66

(56) References Cited

U.S. PATENT DOCUMENTS 5,667,417 A * 9/1997 Stevenson ..... 445/24
5,680,160 A * 10/1997 LaPointe ..... 345/173
6,010,742 A * 1/2000 Tanabe et al. ..... 427/66

* cited by examiner

*Primary Examiner*—Carl J. Arbes
*Assistant Examiner*—T. D. Pham
(74) *Attorney, Agent, or Firm*—Charles C.H. Wu; Wu & Cheung, LLP

(57) ABSTRACT

A method for manufacturing low cost electroluminescent (EL) illuminated membrane switches is disclosed. The method includes the first step of die cutting, embossing or chemically etching the metal foil surface of a metal foil bonded, light transmitting flexible electrical insulation to simultaneously form one or more front capacitive electrodes, membrane switch contacts and electrical shunt, electrical distribution means and electrical terminations that together comprise a flexible printed circuit panel. This continuous flexible printed circuit substrate is then coupled to a precisely positioned indexing system. Next, the front metal foil capacitive electrodes are coated with a light transmissive electrically conductive layer. Then, a layer of electroluminescent phosphor is applied to the electrically conductive layer, a layer of capacitive dielectric is applied insulating the phosphor layer, a rear capacitive electrode is then applied over the capacitive dielectric layer, thus forming an electroluminescent lamp portion. Next, a transparent dielectric coating is applied to the entire surface of the lamp and substrate with open portions exposing electrical terminations, switch contacts and shunt. A spacer is applied to surround the switch shunt, providing an isolation barrier. An intermediary material is applied to the surface of the isolated rear EL electrode thus forming a switch actuator. Finally, the illuminated switch pattern is die-cut from the substrate material, and is then folded into three layers forming the final illuminated membrane switch.

50 Claims, 5 Drawing Sheets

METHOD FOR MANUFACTURING LOW COST ELECTROLUMINESCENT (EL) ILLUMINATED MEMBRANE SWITCHES

BACKGROUND OF THE INVENTION

1. Field of the Invention

The present field of the invention relates to membrane switches, and more particularly to a method for manufacturing membrane switches that are illuminated using electroluminescent lamps.

2. Description of the Prior Art

Present membrane switches are typically made from flexible plastic insulators that contain two layers of opposing electrically conductive surfaces isolated from one another by an air gap such that, when one surface is mechanically deformed by applied pressure, that deformed surface makes mechanical contact against the opposing stationary surface and completes an electrical current path between them. This current path may carry either signal or power electrical charge, or both. By positioning an insulating mask between these two surfaces, effective mechanical isolation ensures that unwanted electrical contact is avoided. Adding illumination to such membrane switches can create both complicated and bulky assemblies that are unsuitable for many electronics product applications. Illuminated membrane switch assemblies made using this method contain three or more individual layers of electrically conductive and isolating materials that require precise alignment for their successful application.

An alternative construction consists of a rigid circuit board having on its upper surface a pair of electrical switch contacts. Positioned above this surface is an isolating mask layer that is typically a plastic film with openings positioned in alignment with the contact pairs. Above that is placed a second plastic film with a deformable electrical shunt surface oppositely positioned in alignment with the isolation mask's openings and the printed circuit board's switch contact pairs. When this outermost shunt layer is mechanically deformed by pressure, the shunt is driven past the isolating mask layer opening such that the shunt may then make contact to the printed circuit board's switch contacts, thus creating a current path. Illuminating this switch construction may take the form of an overlaying elastomeric actuating structure that is edge-lit illuminated by externally mounted lamps or alternatively via light emitting diodes (LED's). Application of an additional layer of electroluminescent lamp construction may also be used to provide illumination to the elastomeric structure. Such constructions typically require an additional rigid framework to keep the various layers in alignment.

An alternative to this second construction is to form the elastomeric actuating structure into an integrated system that begins with a positioning flange that rests on top of the printed circuit board and surrounds the switch contact pair. Projecting from this flange structure is an elastomeric spring member that then supports an actuating key. In the open gap formed by this structure, a typically cylindrical shaped protrusion extends down from the actuating key and is supported above the switch contacts. The end of this protrusion may alternatively be coated with a conductive surface to provide the electrical shunting effect, or a "pill" of conductive elastomer is attached to the protrusion to provide this function. Thus, the actuating key may be pressed, allowing the shunting surface of the protruding conductor to mechanically contact the switch contacts below to from an electrical current path between them. If an additional insulating layer, constructed with electroluminescent lamp elements that surround an opening in the insulation corresponding to the location of the shunting protrusion of the elastomeric actuating structure, is placed between the elastomeric actuating structure and the surface of the switch bearing side of a printed circuit board, a ring of illumination surrounds the actuating key. Additionally, a rigid framework must also be provided to keep the surfaces and structures in alignment.

In the above alternative methods, only signal level electrical charge may be switched by key actuation. Additionally, these structures are also bulky, and require great care in their design and manufacture in order to make them successful for many electrical and electronic applications.

To provide a pleasing tactile "snap" to the above constructions, a layer of formed metal foil shapes may also be applied to replace the shunt layer. These shapes are typically convex on their outer surface and concave on their interior surface. By placing the formed metal foil shapes above the isolating mask layer opening, opposite a switch contact pair, applied mechanical pressure causes the shapes to temporarily invert, thus making contact between the switch contacts. This method allows both signal and power electrical charges to be passed between switch pairs. As this construction also requires individual layers to be assembled, including illuminated actuating elastomeric structures and frames, a bulky and complex assembly results.

Application of electroluminescent lamp as an illumination scheme to the above methodologies provides a thinner structure, however there are still numerous individual layers and actuators to be applied and aligned to complete an illuminated membrane switch assembly. An example of this process is referenced in U.S. Pat. No. 5,680,160 (the '160 patent), wherein LaPointe describes such an application consisting of screen-printed illumination and electrical contacts arranged in a pattern such as might be used for a map as a teaching tool in geography. However, this method only provides illumination during switch contact, and is also limited in the amount of electrical current the switch contacts may carry. The use of conductive inks as switch elements also severely limits their useful life cycle. Additionally, this method does not provide electrical circuit separation between the switch portion and the illumination circuit portion without introducing an additional switch contact and shunt set with attendant construction and isolation layers. Thus, high voltage alternating current may add electrical interference to the switch circuit. As the switch circuit may also make contact for voltage sensitive semiconductor devices, this lack of isolating circuits may cause both electrical interference to, and failure of such devices.

In U.S. Pat. No. 5,667,417, Stevenson teaches a method of producing low cost metal foil based electroluminescent lamps of potentially complex graphic pattern by using a precise indexing system that applies well known flexible circuit technology to a cost-effective continuous production process. Application of this process to the manufacture of illuminated membrane switches can result in switch assemblies that are both low-cost, plus electrically and mechanically superior to those described in the '160 patent.

Thus, there is a need for low profile illuminated membrane switch assemblies that provide all the elements of individually addressable illuminated areas, electrically separated switch and illumination circuitry, plus robust current carrying switch contacts and shunting means. Further, there is a need to provide such a low profile membrane switch assembly that may be made from a single flexible substrate material applied to an automated manufacturing system.

SUMMARY OF THE INVENTION

The present invention is directed to a method of manufacturing EL illuminated membrane switches incorporating some of the processes used in the manufacture of flexible printed circuit boards.

In an exemplary embodiment of the invention, the method of the present invention includes the following steps. In the first step, a light transmissive process carrier film having metal foil bonded to its surface is prepared for further process by die cutting or chemically etching the bonded metal foil to from the desired front capacitive electrode bus, membrane switch contacts and electrical shunt, power input distribution elements and associated electrical contacts to produce a planar flexible circuit board. Following this, the basis flexible circuit board carrier film is placed onto a commercially available transport system that incorporates an optical registration system to precisely position the image area for the remaining print and die cutting process cycles. This method allows the precise (+/−<0.002" in X, Y and θ axis) physical positioning of the basis carrier film without deleterious effect upon the positioning reference means. Using this positioning method allows practically unlimited numbers of print layers to be applied, and final die cutting of the completed product, without concern for layer-to-layer alignment.

The third step consists of printing a light transmissive, electrically conductive ink to precisely form a capacitive front electrode. Through precise, optically registered positioning the capacitive front electrode ink is allowed minimal bleed onto the front capacitive electrode bus.

In the fourth step a high dielectric, hygrophobically compounded EL phosphor ink is printed over the front electrode ink to further define the illuminated area. Precise, optically registered positioning of the basis carrier film allows precision phosphor application onto the front capacitive electrode element. Following this, in the fifth step, a layer of capacitive dielectric ink is applied to cover the EL phosphor layer, completely isolating the front capacitive electrode, phosphor layers and their associated power distribution elements. The capacitive dielectric layer ink is allowed to bleed beyond the EL phosphor layer and front electrode elements and power distribution elements to provide this electrical isolation.

Next then, in step six, a rear electrode layer of electrically conductive ink is applied to further define the precise illuminated area. This layer is allowed to bleed onto the rear electrode power distribution element, providing an electrical path to input power.

In step seven; a polyester film or ultraviolet activated dielectric coating is applied to the entire metal foil surface of the process carrier film. Openings in this layer are made allowing exposure of the metal foil layer to precisely define membrane switch contacts and electrical shunt, plus isolated electrical power contact termination areas.

Steps eight and nine comprise the printing of an isolation element and an actuating element from thick film elastomeric ink. The isolation element is printed as a frame shape surrounding the shunt portion, while the actuating element is printed as a hemispherical bump on top of the dielectric coating and is centered over the EL rear electrode.

Following this step, the completed EL lamp and membrane switch subassembly is then cut from the basis carrier film, then folded into three layers comprising the switch contact layer, the shunt layer and the illuminated actuator layer to which mechanical force may be applied to operate the switch.

A first embodiment of an EL illuminated membrane switch manufactured by the method of the present invention comprises a light transmissive, single-sided flexible printed circuit substrate containing both switch and EL lamp elements, electrical distribution elements and electrical input and output terminations. The EL lamp layers are progressively applied beginning with the front electrode light transmissive, electrically conductive ink, followed by hygrophobically compounded electroluminescent phosphor ink to define the illumination pattern, then capacitive dielectric ink to electrically isolate the front electrode and phosphor layers, followed by an electrically conductive ink layer that defines the rear capacitive electrode, finishing with an electrically insulated and environmentally isolated encapsulation layer that is patterned to protectively insulate all EL portions while leaving exposed all switch elements and electrical contacts. Flexible, thick-film elastomeric ink is then applied to create both a switch isolation mask pattern located around the switch shunt portion and a mechanical actuator bump on the rear surface of the EL lamp portion. The EL illuminated membrane switch is then die-cut from the surrounding substrate material, folded into three layers that comprise switch, shunt and illuminated portions to complete the assembly.

In a second preferred embodiment, a double-sided flexible circuit substrate with switch contacts and switch shunt, associated electrical distribution elements and electrical contact terminals formed on one surface; EL lamp rear electrode and front capacitive electrode bus elements, electrical distribution elements and electrical input contact terminals are formed upon the opposite surface. EL lamp layers are sequentially applied in order of a first capacitive dielectric layer isolating the rear electrodes and associated electrical distribution elements from the front electrode bus; application of hygrophobically compounded electroluminescent phosphor ink on top of the capacitive dielectric layer to precisely define the illuminated pattern; application of electrically conductive, light transmissive ink over the EL phosphor layer and bridging onto the front capacitive electrode power distribution bus to create a front capacitive electrode; then, application of a light transmissive, electrically insulated and environmentally isolated encapsulation layer that is patterned to protectively insulate all EL portions while leaving exposed all EL lamp portion electrical contacts. The EL illuminated membrane switch subassembly is then die-cut and formed from the surrounding substrate material, creating an embossed portion surrounding the switch shunt acting as a spring element, thus isolating the shunt; then folded into three layers that comprise switch, shunt and illuminated portions to complete the assembly.

In a third preferred embodiment, a double-sided flexible circuit substrate with switch contacts and switch shunt, (the shunt element positioned approximately opposite the EL lamp rear capacitive electrode center), electrical distribution elements and electrical contacts formed on one surface; EL lamp rear capacitive electrode and front capacitive electrode power distribution bus elements, electrical distribution elements and electrical input contact terminations are formed upon the opposite surface. EL lamp layers are sequentially applied in order of first capacitive dielectric layer to isolate the rear capacitive electrodes and their associated electrical distribution elements from the front capacitive electrode bus; application of hygrophobically compounded electroluminescent phosphor ink on top of the capacitive dielectric layer to precisely define the illuminated pattern; application of electrically conductive, light transmissive ink over the EL phosphor layer bleeding onto the front capacitive electrode power distribution bus to create a front capacitive electrode; then application of a light transmissive, electrically insulated and environmentally isolated encapsulation layer that is patterned to protectively insulate all EL portions leaving exposed all EL lamp portion electrical contact terminals. The EL illuminated membrane switch is then die-cut and formed from the surrounding substrate material, creating an embossed portion that acts as a spring element surrounding an aperture opening isolating the shunt from the switch contacts; finally then, folded into three layers that comprise switch portion, isolation layer portion, shunt and illuminated portion to complete the assembly.

The method of the present invention provides the ability to manufacture EL illuminated membrane switches at a cost fractional of that of comparable conventional construction. Additionally, these lower-cost EL illuminated membrane switches can be manufactured on readily obtainable automated production equipment. Further features and advantages of the present invention will be appreciated by a review of the following detailed description when taken in conjunction with the following drawings.

BRIEF DESCRIPTION OF THE DRAWINGS

The present invention may be best understood by referring to the following detailed description of the preferred embodiments and the accompanying drawings, wherein like numerals denote like elements and in which.

DETAILED DESCRIPTION OF THE PREFERRED EMBODIMENTS

The following exemplary discussion focuses upon the manufacture of an electroluminescent illuminated membrane switch. The electroluminescent illuminated membrane switch produced by the method of the present invention is suitable for a variety of electronics, electrical and other lighted switch applications.

Figure 1:
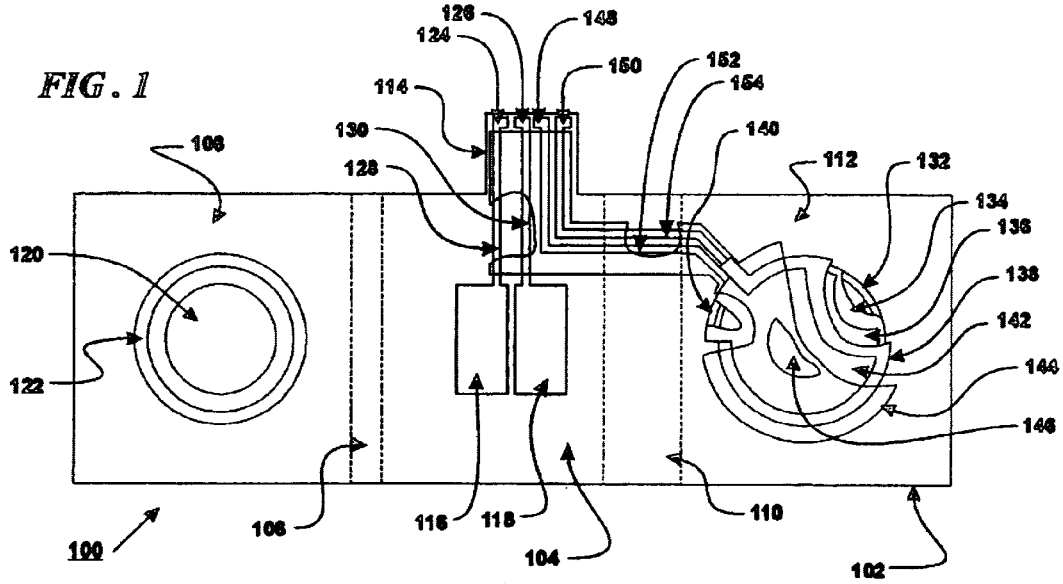
FIG. 1 is a top view diagram illustrating the process subassembly of a first exemplary electroluminescent illuminated membrane switch 100 constructed in accordance with the present invention.

Referring to FIG. 1, a top view diagram illustrating a preferred electroluminescent illuminated membrane switch subassembly made in accordance with the present invention is shown. In the first step of the method, typically an approximately 0.001 inch thick metal foil is die cut or chemically etched to form one or more front capacitive electrode power distribution bus elements 132, rear capacitive electrode power distribution bus 140, electrical power contacts 124, 126, 148 and 150, switch contact elements 116 and 118, switch shunt 120, electrical distribution elements 128, 130, 152 and 154 that are all permanently bonded to a light transmissive plastic film core stock 102. Alternatively, the metal foil can be embossed onto plastic film core stock 102 from a separate metal foil supply.

Alternatively, front capacitive electrode power distribution bus elements 132, rear capacitive electrode power distribution bus 140, electrical power contacts 124, 126, 148 and 150, switch contact elements 116 and 118, switch shunt 120, electrical distribution elements 128, 130, 152 and 154 may be printed in electrically conductive ink upon the surface of plastic film core stock 102. Additional alternate construction includes the use of a patterned conductive polymer layer to substitute for the metal foil layer of plastic film core stock 102. The typical thickness of plastic film core stock 102 is approximately 0.005 inch. The die cutting or chemical etching process can be performed by any of numerous conventional means. Additionally, the plastic film core stock 102 may be coupled to a conventional optically registered flat stock indexing feed mechanism (not shown) to facilitate automated production.

In the next step, a layer of electrically conductive, light transmissive ink is applied over front capacitive electrode power distribution bus elements 132 to create a front capacitive plate 134. In an alternative step, the electrically conductive, light transmissive ink layer forming front capacitive electrode 134 may be augmented or replaced by a conductive metal oxide layer such as indium tin oxide (ITO). In another alternative step, the front capacitive electrode 134 may be augmented or replaced by a conductive, light transmissive polymer layer such as PEDOT, (Poly-3, 4-Ethyelenedioxithiophene).

In the following step, a layer of hygrophobically compounded EL phosphor ink 136 is applied over the front capacitive plate 134 providing a precisely defined illumination pattern. Following this, hygrophobically compounded capacitive dielectric ink 138 is applied over phosphor layer 136. The capacitive dielectric ink 138 is allowed to bleed approximately 0.020 inch beyond the edges of the front capacitive electrode power distribution bus element 132, and up to the inside edge of rear capacitive power distribution bus 140, thereby electrically insulating front electrode 134, phosphor layer 136 and power distribution element 154. Additionally, the dielectric ink may also extend well beyond the rear electrode pattern so as to provide a positive aesthetic appearance to the final assembly. Additionally, the dielectric ink may be dyed or imbued with pigmentation to provide for illuminated and non-illuminated color effects.

An electrically conductive ink layer is then applied over capacitive dielectric ink layer 138 defining a rear capacitive electrode 142. The electrically conductive ink layer 142 is allowed to bleed beyond the capacitive dielectric layer 138 and onto rear capacitive power distribution bus 140, completing electrical connection therebetween and providing a means to address electrical power to rear capacitive electrode 142. The use of an optically registered flat stock indexing feed mechanism allows the distribution of capacitive dielectric ink, El phosphor ink and electrically conductive inks to be specifically limited to those areas which are to be illuminated. For example, complex graphical patterns such as circles within circles, text, or individually addressable EL lamp indicia elements may be created.

As shown in FIG. 1, the rear capacitive electrode 144 and the EL phosphor layer 138 define a rectangular area of illumination. However, the specific shape of the area of illumination is not limited to simple rectangles, circles and polygons. Any pattern with which the rear capacitive electrode 104 may be made and any pattern that may be printed in EL phosphor ink may also define the area of illumination. Similarly, the shapes of switch contacts 116 and 118, and the switch shunt 120 may also be defined as shapes other than simple rectangles, squares or circles.

Continuing with FIG. 1, a polyester film is applied over the entire lamp surface to provide electrical and environmental encapsulation layer 144. Typical application of environmental encapsulation layer 144 leaves electrical power contacts 124, 126, 148 and 150, switch contact elements 116 and 118, and switch shunt 120 exposed. Ordinarily, environmental encapsulation layer 144 is approximately 0.0005–0.010 in thickness, depending upon the level of isolation desired for specific applications. An alternative to polyester film environmental encapsulation 144 is polycarbonate, or any other plastic film or sheet suitable for specific illuminated switch applications. An alternative construction also allows use of screen-printable, or flood-coated, ultraviolet light activated encapsulating inks as environmental encapsulation 144.

In the next step, spacer 122 and switch actuator 146 are printed using thick film elastomer inks. Spacer 122 surrounds switch shunt 120 providing mechanical and electrical isolation. Switch actuator 146 is printed as a hemispherical bump on top of encapsulation layer 144 located in relation to the center of rear capacitive electrode 142. Alternatively, spacer 122 and switch actuator 146 may also be printed thick film adhesive. Another alternative construction of spacer 122 and switch actuator 146 may be adhesively mounted, molded or die cut plastic forms.

Upon completion of all printing and lamination processes, plastic core stock 102 is further trimmed via die cutting to form a subassembly of flexible elements that define operating surfaces of the finished EL illuminated membrane switch. These elements consist of stationary switch contact plane 104, hinge portion 106, switch shunt plane 108, hinge portion 110, EL illuminated actuator plane 112, and electrical connector tab 114.

In an alternative first step, the metal foil may be replaced by a metal plated surface that is patterned into front capacitive electrode power distribution bus elements 132, rear capacitive electrode power distribution bus 140, electrical power contacts 124, 126, 148 and 150, switch contact elements 116 and 118, switch shunt 120, and electrical distribution elements 128, 130, 152 and 154.

In another alternative first step, an electrically conductive plastic film that has been die cut or chemically modified to create the above referenced electrical elements may replace the metal foil. In addition, a plastic dielectric film imbued with EL phosphors may replace the EL phosphor ink layer 136. Similarly, the conductive ink front capacitive electrode 134 may be replaced or augmented by a plating of ITO or other metal/metal oxide light transmissive, electrically conductive layer applied over the front capacitive electrode power distribution bus elements 132.

Plastic core stock 102 may be replaced any variety of flexible non-conducting materials such as a thin fiber reinforced plastic or plastic laminated paper.

Figure 2:
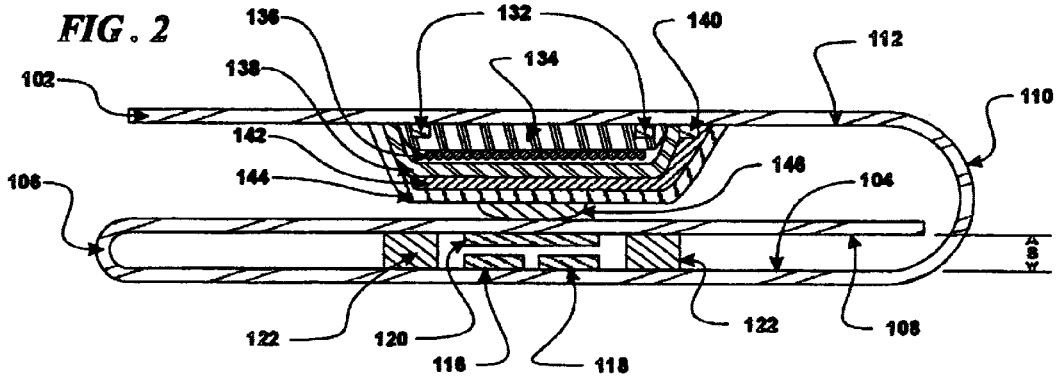
FIG. 2 is a cross-sectional view of a first exemplary electroluminescent illuminated membrane switch 100 constructed in accordance with the present invention.

Referring now to FIG. 2, a cross-sectional view of the construction of a first exemplary EL illuminated membrane switch 100, constructed in accordance with the FIG. 1 method is shown. EL illuminated membrane switch 100 includes plastic core stock 102; stationary switch contact plane 104; hinge portion 106; switch shunt plane 108; hinge portion 110; EL illuminated actuator plane 112; electrically isolated switch contacts 116 and 118; mechanical spacer 122 that defines isolation space S; front capacitive electrode power distribution bus 132; light transmissive, electrically conductive front capacitive electrode 134; electroluminescent phosphor layer 136; capacitive dielectric layer 138; rear capacitive electrode power distribution bus 140; rear capacitive electrode 142; environmental encapsulation layer 144; and switch actuator 146.

When suitable alternating (AC), or pulsed direct current (DC) voltage is applied to power distribution buses 132 and 140, electrical energy is transferred to capacitive electrodes 134 and 142 causing EL phosphor layer 138 to fluoresce with visible light.

Hinge portion 106 is positioned such that switch shunt actuator plane 108 substantially parallels stationary switch contact plane 104, locating switch shunt 120 directly opposite switch contacts 116 and 118. Spacer 122 isolates switch shunt 120 from switch contacts 116 and 118, creating an opening defining isolation space S. Hinge portion 110 is positioned such that EL illuminated actuator plane 112 substantially parallels stationary switch contact plane 104, locating EL lamp elements 132, 134, 136, 138, 142, and switch actuator 146 approximately centered above switch shunt 120 such that, when mechanical pressure is applied to EL illuminated actuator plane 112, said mechanical force is transferred throughout all intervening layers to the interface between switch actuator 146 and switch shunt actuator plane 108. Switch shunt actuator plane 108 is thus deformed such that switch shunt 120 is forced against switch contacts 116 and 118, thereby creating an electrical current path between switch contacts 116 and 118.

Referring again to FIG. 2, note that capacitive dielectric insulation layer 138 is allowed to fill the gap between the rear capacitive electrode power distribution bus 140 and front capacitive electrode 134. Also note that EL phosphor layer 136 is not allowed to bleed outside of front capacitive electrode power distribution bus 132. Note also that capacitive dielectric layer 138 provides complete isolation of both front capacitive electrode 134 and EL phosphor layer 136 from rear capacitive electrode 142. Additionally, electrically conductive layer 134 contacts the front capacitive electrode power distribution bus 132 making electrical connection therebetween. Rear capacitive electrode 142 is allowed to bleed onto rear capacitive power distribution bus 140, thus forming electrical contact therebetween. Polyester film environmental encapsulation 144 bleeds beyond all previous layers and extends onto plastic core stock 102, providing both electrical safety isolation and an environmental attack resistant encapsulating envelope. Finally, switch actuator 146 is designed such as to minimize unwanted flexing of the EL illumination layers, while it is also large enough to provide ample pressure to force switch shunt 120 against switch contacts 116 and 118.

In an alternative construction, switch shunt 120 and switch shunt actuator plane 108 may be embossed to form a snap action shape. Switch shunt 120 may be shaped as a concave surface bounded by spacer 122, while switch shunt actuator plane 108 is shaped as a convex surface inboard of spacer 122 that mechanically interfaces actuator 146. This construction provides a satisfying tactile "snap" when force is applied by actuator 146.

Figure 3:
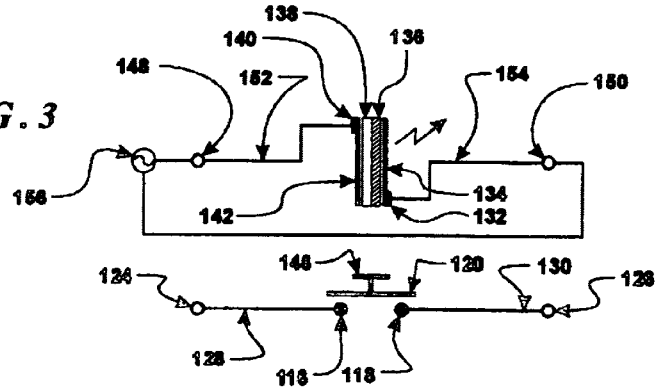
FIG. 3 is a schematic diagram of an equivalent circuit of a first exemplary electroluminescent illuminated membrane switch 100.

FIG. 3 provides an electrical schematic diagram of the various elements of preferred embodiment 100. When force is applied to actuator 146, shunt 120 bridges contacts 116 and 118. Electrical current path is then made beginning at terminal 124, carried by distribution path 128 to contact 116, bridging through shunt 120 to contact 118, carried by distribution path 130 to terminal 126. In a separate portion of this schematic diagram, alternating current 156 is applied to electrical terminations 148 and 150. Current flow from electrical termination 148 is carried by distribution element 152 to rear capacitive electrode power distribution bus 140, and hence to rear capacitive plate 142. Oppositional AC current 156 is applied to electrical contact 150, carried by distribution element 154 to front capacitive electrode power distribution bus 132, and thence to front capacitive plate 134. Capacitive dielectric layer 138 isolates electroluminescent phosphor 136 and, together these layers form a light emitting capacitor dielectric. Front capacitive plate 134 is light transmissive, allowing visible light to escape the construction.

This isolated construction method allows the electroluminescent lamp portion to be independently addressed relative to the switch functions. However, by series connection of the switch portion to the electroluminescent lamp portion and the AC power source 156, successful switch contact actuation may be confirmed by concurrent EL lamp illumination.

Figure 4:
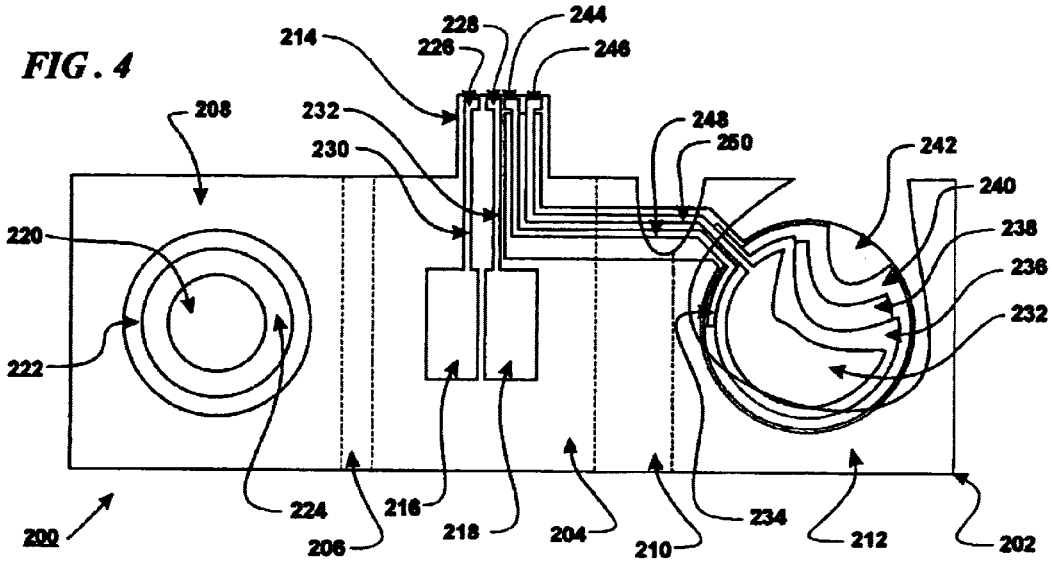
FIG. 4 is a top view diagram illustrating the process subassembly of a second exemplary electroluminescent illuminated membrane switch 200.

FIG. 4 is a top view diagram illustrating a second preferred embodiment of an electroluminescent illuminated membrane switch 200 in accordance with the present invention. In the first step of the method, typically an approximately 0.001 inch thick metal foil is die cut or chemically etched to form one or more rear capacitive electrodes 232, front capacitive electrode power distribution bus 234, electrical power contacts 244 and 246, electrical distribution elements 248 and 250 that are all permanently bonded to one surface of a plastic film core stock 202. An approximately 0.001 inch thick metal foil is die cut or chemically etched to form switch contacts 216 and 218, switch shunt 220, electrical power contacts 226 and 228, electrical distribution elements 230 and 232 that are all permanently bonded to the opposite surface of core stock 202.

Alternatively, the metal foil can be embossed onto plastic film core stock 202 from a separate metal foil supply. Alternatively, front capacitive electrode power distribution bus elements 234, rear capacitive electrode 232, electrical power contacts 226, 228, 244 and 246, switch contact elements 216 and 218, switch shunt 220, electrical distribution elements 230, 232, 248 and 250 may be printed in electrically conductive ink upon the opposing surfaces of core stock 202. The typical thickness of plastic film core stock 202 is approximately 0.005 inch. The die cutting or chemical etching processes can be performed by any of numerous conventional means. Additionally, the plastic film core stock 202 may be coupled to a conventional optically registered flat stock indexing feed mechanism (not shown) to facilitate automated production.

In the next step, a layer of capacitive dielectric ink 236 is applied over rear capacitive electrode 232, bleeding approximately 0.020 inch beyond rear capacitive electrode 232, extending well over electrical distribution element 250 and also up to the inside edge of front capacitive electrode power distribution bus 234, thereby insulating rear capacitive electrode 232. Additionally, the dielectric ink may also extend well beyond the rear electrode pattern so as to provide a positive aesthetic appearance to the final assembly. Further, the dielectric ink may be dyed or imbued with pigmentation to provide for illuminated and non-illuminated color effects.

Further in FIG. 2, a layer of hygrophobically compounded EL phosphor ink 238 is applied over the dielectric layer 236 providing a precisely defined illumination pattern. Next is to print front capacitive plate 240 using electrically conductive, light transmissive ink that is allowed to bleed onto power distribution bus 234. In an alternative step, the electrically conductive, light transmissive ink layer forming front capacitive electrode 240 may be augmented or replaced by a conductive metal oxide layer such as indium tin oxide (ITO).

The use of an optically registered flat stock indexing feed mechanism allows the distribution of capacitive dielectric ink, El phosphor ink and electrically conductive inks to be specifically limited to those areas which are to be illuminated. For example, complex graphical patterns such as circles within circles, text, or individually addressable EL lamp indicia elements may be created.

As shown in FIG. 4, the rear capacitive electrode 232 and the EL phosphor layer 238 define a circular area of illumination. However, the specific shape of the area of illumination is not limited to simple rectangles, circles and polygons. Any pattern with which the rear capacitive electrode 232 may be made and any pattern that may be printed in EL phosphor ink may also define the area of illumination. Similarly, the shapes of switch contacts 216 and 218, and the switch shunt 220 may also be defined as shapes other than simple rectangles, squares or circles.

Continuing with FIG. 4, a light transmissive polyester film is applied over the entire lamp surface to provide electrical and environmental encapsulation layer 242. Typical application of environmental encapsulation layer 242 leaves electrical power contacts 244 and 246 exposed. Ordinarily, environmental encapsulation layer 242 is approximately 0.0005–0.010 in thickness, depending upon the level of isolation desired for specific applications. An alternative to polyester film environmental encapsulation 242 is polycarbonate, or any other plastic film or sheet suitable for specific illuminated switch applications. An alternative construction also allows use of screen-printable, or flood-coated, ultraviolet activated light transmissive encapsulating inks as environmental encapsulation 242.

Upon completion of all printing and lamination processes, plastic core stock 202 is further trimmed via die cutting to form flexible elements that define operating surfaces of the finished EL illuminated membrane switch. These elements consist of stationary switch contact plane 204, hinge portion 206, switch shunt plane 208, hinge portion 210, EL illuminated actuator plane 212, and electrical connector tab 214. During the die cutting process, an area of stationary switch contact plane 204 is embossed to create serpentine spring member 222 and switch actuator portion 224. Spring member 222 surrounds switch shunt 220 providing mechanical and electrical isolation. Switch actuator portion 224 is defined as the area inboard of spring member 222.

In an alternative first step, the metal foil of either surface of core stock 202 may be replaced by a metal plated surface that is formed into front capacitive electrode power distribution bus elements 234, rear capacitive plate 232, electrical power contacts 226, 228, 244 and 246, switch contact elements 216 and 218, switch shunt 220, and electrical distribution elements 230, 232, 248 and 250.

In another alternative first step, a double sided, electrically conductive plastic film that has been die cut or chemically modified to create the above referenced electrical elements may replace the metal foil. In addition, a plastic dielectric film imbued with EL phosphors may replace the EL phosphor ink layer 236. Similarly, the conductive ink front capacitive electrode 238 may be replaced or augmented by a plating of ITO or other metal/metal oxide light transmissive, electrically conductive layer applied over the front capacitive electrode power distribution bus elements 234.

Plastic film core stock 202 may be replaced any variety of flexible non-conducting materials such as a thin fiber reinforced plastic, or alternately a plastic coated paper.

Figure 5:
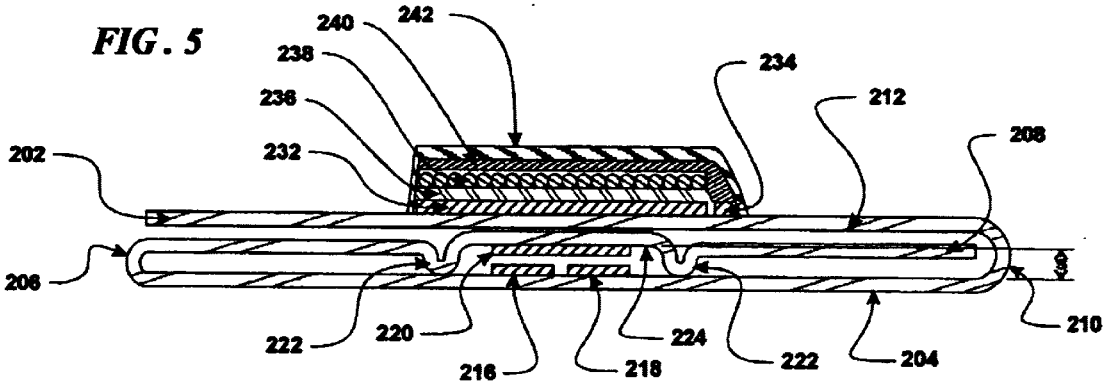
FIG. 5 is a cross-sectional view of electroluminescent illuminated membrane switch 200 of FIG. 4.

Referring now to FIG. 5, a cross-sectional view of the construction of second exemplary EL illuminated membrane switch 200, constructed in accordance with the FIG. 4 method is shown. EL illuminated membrane switch 200 includes plastic core stock 202; stationary switch contact plane 204; hinge portion 206; switch shunt plane 208; hinge portion 210; EL illuminated actuator plane 212; electrically isolated switch contacts 216 and 218; spring member 222 and switch actuator portion 224 defining isolation space S; front capacitive electrode power distribution bus 234; light transmissive, electrically conductive front capacitive electrode 240; electroluminescent phosphor layer 238; capacitive dielectric layer 236; front capacitive electrode power distribution bus 234; rear capacitive plate 232; environmental encapsulation layer 242; and switch actuator portion 224.

When suitable alternating (AC), or pulsed direct current (DC) voltage is applied to rear capacitive plate 232, and via power distribution bus 234 to front capacitive plate 240, EL phosphor layer 238 fluoresces with visible light.

Hinge portion 206 is positioned such that switch shunt actuator plane 208 substantially parallels stationary switch contact plane 204, locating switch shunt 220 approximately opposite switch contacts 216 and 218. Spring member 222 and switch actuator portion 224 isolate switch shunt 220 from switch contacts 216 and 218, creating an opening that defines isolation space S. Hinge portion 210 is positioned such that EL illuminated actuator plane 212 substantially parallels stationary switch contact plane 204, locating EL lamp elements 232, 234, 236, 238, and 240 approximately centered above switch shunt 220 such that, when mechanical pressure is applied to encapsulation layer 242, said mechanical force is transferred between intervening layers to the interface between EL illuminated actuator plane 212 and switch actuator portion 224, and thence switch shunt 220. Switch shunt actuator portion 224 is thus deformed such that switch shunt 220 is forced against switch contacts 216 and 218, thereby creating an electrical current path between switch contacts 216 and 218.

Referring again to FIG. 5, note that capacitive dielectric insulation layer 236 is allowed to fill the gap between the front capacitive electrode power distribution bus 234 and rear capacitive plate 232. Also note that EL phosphor layer 238 is not allowed to bleed outboard of rear capacitive electrode 232. Note also that capacitive dielectric layer 238 provides complete isolation of rear capacitive plate 232, thus electrically isolating EL phosphor layer 238. Additionally, electrically conductive layer 240 contacts the front capacitive electrode power distribution bus 234 making electrical connection therebetween. Polyester film environmental encapsulation 242 bleeds beyond all previous layers and extends onto plastic core stock 202, providing both electrical safety isolation and an environmental attack resistant encapsulating envelope.

In an alternative construction, switch shunt 220 and switch shunt actuator portion 224 may be embossed to form a snap acting shape. Switch shunt 220 may be shaped as a substantially concave surface bounded by serpentine spring member 222, while switch shunt actuator portion 224 is shaped as a substantially convex surface that mechanically interfaces with illuminated actuator plane 212. This construction provides a satisfying tactile "snap" when mechanical force is applied by actuation of illuminated actuator plane 212.

Figure 6:
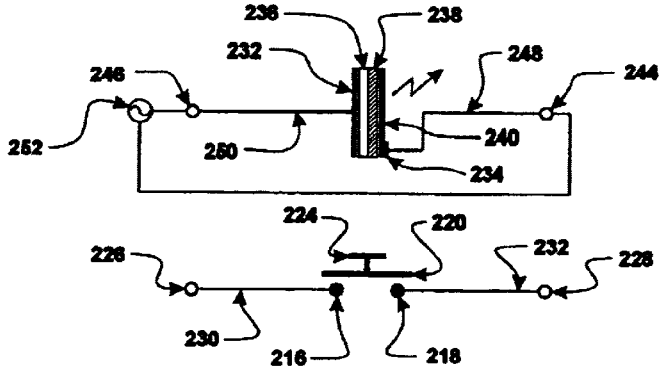
FIG. 6 is a schematic diagram of an equivalent circuit of electroluminescent illuminated membrane switch 200 of FIG. 4.

FIG. 6 provides an electrical schematic diagram of the various elements of preferred embodiment 200. When force is applied to switch actuator portion 224, shunt 220 bridges contacts 216 and 218. Electrical current path is then made beginning at terminal 226, carried by distribution path 230 to contact 216, bridging through shunt 220 to contact 218, carried by distribution path 232 to terminal 228. In a separate portion of this schematic diagram, alternating current 252 is applied to electrical terminations 244 and 246. Current flow from electrical termination 246 is carried by distribution element 250 to rear capacitive plate 232. Oppositional AC current 252 is applied to electrical contact 244, carried by distribution element 248 to front capacitive electrode power distribution bus 234, and thence to light transmissive front capacitive plate 240. Capacitive dielectric layer 236 isolates electroluminescent phosphor 238, and, together these layers form a light emitting capacitor dielectric.

This isolated construction method allows the electroluminescent lamp portion to be independently addressed relative to the switch functions. However, by series connection of the switch portion with the electroluminescent lamp portion and to the AC power source 252, successful switch contact actuation may be confirmed by concurrent EL lamp illumination.

Figure 7:
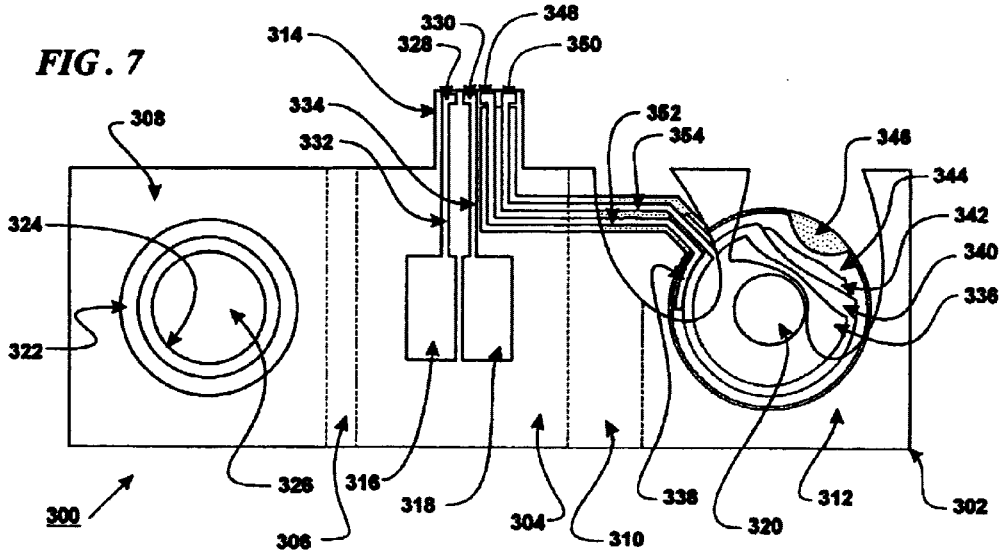
FIG. 7 is a top view diagram illustrating the process subassembly of a third exemplary EL lamp electroluminescent illuminated membrane switch 300.

FIG. 7 is a top view diagram illustrating a third preferred embodiment of an electroluminescent illuminated membrane switch 300 in accordance with the present invention. In the first step of the method, typically an approximately 0.001 inch thick metal foil is die cut or chemically etched to form one or more rear capacitive plates 336, front capacitive electrode power distribution bus 338, electrical power contacts 348 and 350, electrical distribution elements 352 and 354 that are all permanently bonded to one surface of a plastic film core stock 302. An approximately 0.001 inch thick metal foil is die cut or chemically etched to form switch contacts 316 and 318, switch shunt 320, electrical power contacts 328 and 330, electrical distribution elements 332 and 334 that are all permanently bonded to the opposite surface of core stock 302. Alternatively, the metal foil can be embossed onto plastic film core stock 302 from a separate metal foil supply. Alternatively, front capacitive electrode power distribution bus elements 338, rear capacitive plate 336, electrical power contacts 328, 330, 348 and 350, switch contact elements 316 and 318, switch shunt 320, electrical distribution elements 332, 334, 352 and 354 may be printed in electrically conductive ink upon the opposing surfaces of core stock 302. The typical thickness of plastic film core stock 302 is approximately 0.005 inch. The die cutting or chemical etching can be performed by any of numerous conventional means. Additionally, the plastic film core stock 302 may be coupled to a conventional optically registered flat stock indexing feed mechanism (not shown) to facilitate automated production.

In the next step, a layer of capacitive dielectric ink 340 is applied over rear capacitive electrode 336, bleeding approximately 0.020 inch beyond rear capacitive plate 336, extending well over electrical distribution element 354 and also up to the inside edge of front capacitive electrode power distribution bus 338, thereby insulating rear capacitive plate 336. Additionally, the dielectric ink may also extend well beyond the rear electrode pattern so as to provide a positive aesthetic appearance to the final assembly. Additionally, the dielectric ink may be dyed or imbued with pigmentation to provide for illuminated and non-illuminated color effects.

Following this, a layer of hygrophobically compounded EL phosphor ink 342 is applied over the dielectric layer 340 providing a precisely defined illumination pattern. Next is to print front capacitive electrode 344 using electrically conductive, light transmissive ink that is allowed to bleed onto power distribution bus 338. In an alternative step, the electrically conductive, light transmissive ink layer forming front capacitive plate 344 may be augmented or replaced by a conductive metal oxide layer such as indium tin oxide (ITO).

The use of an optically registered flat stock indexing feed mechanism allows the distribution of capacitive dielectric ink, El phosphor ink and electrically conductive inks to be specifically limited to those areas which are to be illuminated. For example, complex graphical patterns such as circles within circles, text, or individually addressable EL lamp indicia elements may be created.

As shown in FIG. 7, the rear capacitive plate 336 and the EL phosphor layer 342 define a circular area of illumination. However, the specific shape of the area of illumination is not limited to simple rectangles, circles and polygons. Any pattern with which the rear capacitive plate 336 may be made and any pattern that may be printed in EL phosphor ink may also define the area of illumination. Similarly, the shapes of switch contacts 316 and 318, and of switch shunt 320 may also be defined as shapes other than simple rectangles, squares or circles.

Now continuing with FIG. 7, a light transmissive polyester film is applied over the entire lamp surface to provide electrical and environmental encapsulation layer 346. Typical application of environmental encapsulation layer 346 leaves electrical power contacts 348 and 350 exposed. Ordinarily, environmental encapsulation layer 346 is approximately 0.0005–0.010 in thickness, depending upon the level of isolation desired for specific applications. An alternative to polyester film environmental encapsulation 346 is polycarbonate, or any other plastic film or sheet suitable for specific illuminated switch applications. An alternative construction also allows use of screen-printable, or flood-coated, ultraviolet activated light transmissive encapsulating inks as environmental encapsulation 346.

Upon completion of all printing and lamination processes, plastic core stock 302 is further trimmed via die cutting to form flexible elements that define operating surfaces of the finished EL illuminated membrane switch. These elements consist of stationary switch contact plane 304, hinge portion 306, isolation plane 308, hinge portion 310, EL illuminated actuator plane 312, and electrical connector tab 314. During the die cutting process, an area of isolation plane 308 is embossed to create serpentine spring member 322 and aperture opening 324. Spring member 322 surrounds aperture opening 324 providing mechanical and electrical isolation between switch contacts 316 and 318, and switch shunt 320.

In an alternative first step, the metal foil of either surface of core stock 302 may be replaced by a metal plated surface that is formed into front capacitive electrode power distribution bus elements 338, rear capacitive plate 336, electrical power contacts 328, 330, 348 and 350, switch contact elements 316 and 318, switch shunt 320, and electrical distribution elements 332, 334, 352 and 354.

In another alternative first step, a double sided, electrically conductive plastic film that has been die cut or chemically modified to create the above referenced electrical elements may replace the metal foil. In addition, a plastic dielectric film imbued with EL phosphors may replace the EL phosphor ink layer 342. Similarly, the conductive ink front capacitive plate 344 may be replaced or augmented by a plating of ITO or other metal/metal oxide light transmissive, electrically conductive layer applied over the front capacitive electrode power distribution bus elements 338.

Plastic film core stock 302 may be replaced any variety of flexible non-conducting materials such as a thin fiber reinforced plastic or plastic coated paper.

Figure 8:
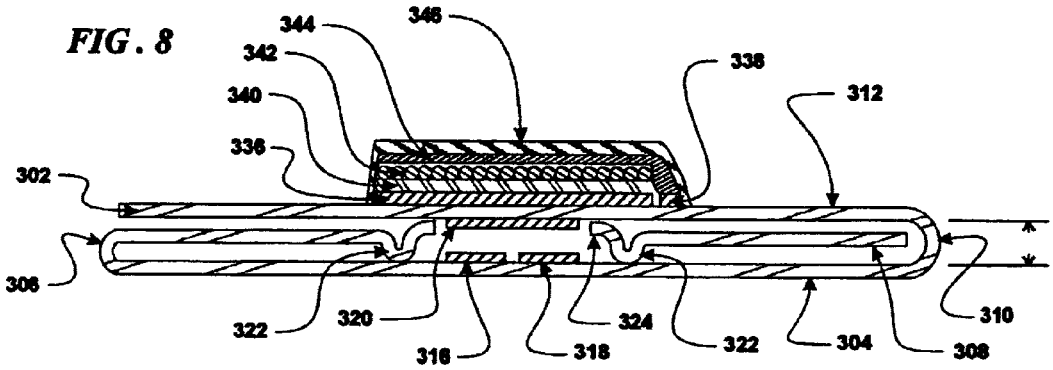
FIG. 8 is a cross-sectional view of electroluminescent illuminated membrane switch 300 of FIG. 7.
Figure 8:
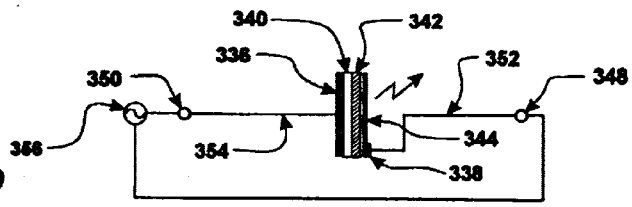

Referring now to FIG. 8, a cross-sectional view of the construction of third exemplary EL illuminated membrane switch 300, constructed in accordance with the FIG. 7 method is shown. EL illuminated membrane switch 300 includes plastic core stock 302; stationary switch contact plane 304; hinge portion 306; isolation plane 308; hinge portion 310; EL illuminated actuator plane 312; electrically isolated switch contacts 316 and 318; serpentine spring member 322 and aperture opening 324 defining isolation space S; rear capacitive plate 336; front capacitive electrode power distribution bus 338; light transmissive, electrically conductive front capacitive electrode 344; electroluminescent phosphor layer 342; capacitive dielectric layer 340; and environmental encapsulation layer 346.

When suitable alternating (AC), or pulsed direct current (DC) voltage is applied to rear capacitive plate 336, and via power distribution bus 338 to front capacitive plate 344, EL phosphor layer 342 fluoresces with visible light.

Hinge portion 306 is positioned such that isolation plane 308 substantially parallels stationary switch contact plane 304, locating aperture opening 324 approximately opposite switch contacts 316 and 318. Serpentine spring member 322 projects from isolation plane 308 and is substantially centered opposite of switch contacts 316 and 318. Further, spring member 322 forms a frame outboard of switch contacts 316 and 318, and in conjunction with aperture opening 324 creates an opening that defines isolation space S. Aperture opening 324, slightly larger in size than the profile of switch shunt 320 forms an access path for switch shunt 320 to make connection with switch contacts 316 and 318. Hinge portion 310 is positioned such that EL illuminated actuator plane 312 substantially parallels stationary switch contact plane 304, locating switch shunt 320 approximately opposite aperture 324 and switch contacts 316 and 318. EL lamp elements 336, 340, 342, and 344 are essentially centered above switch shunt 320 such that, when mechanical pressure is applied to encapsulation layer 346, mechanical force is transferred between intervening layers to switch shunt 320. Switch shunt 320 and serpentine spring element 322 are thus compressively deformed such that switch shunt 320 is forced against switch contacts 316 and 318, thereby creating an electrical current path between switch contacts 316 and 318. Upon release of mechanical pressure applied to encapsulation layer 346, spring element 322 returns to its relaxed mechanical state, forcibly separating switch shunt 320 from switch contacts 316 and 318 thus recreating isolation space S.

Again referring to FIG. 8, note that capacitive dielectric insulation layer 340 is allowed to fill the gap between the front capacitive electrode power distribution bus 338 and rear capacitive plate 336. Also note that EL phosphor layer 342 is not allowed to bleed outboard of rear capacitive plate 336. Note also that capacitive dielectric layer 340 provides complete isolation of rear capacitive plate 336, thus electrically isolating EL phosphor layer 342. Additionally, electrically conductive layer 344 contacts the front capacitive electrode power distribution bus 338 making electrical connection therebetween. Polyester film environmental encapsulation 346 bleeds beyond all previous layers and extends onto plastic core stock 302, providing both electrical safety isolation and an environmental attack resistant encapsulating envelope.

In an alternative construction, switch shunt 320, EL illuminated actuator plane 312 and EL lamp elements 336, 340, 342, and 344 may be embossed to form a snap action shape. Switch shunt 320 may be shaped as a substantially concave surface approximating the size of aperture 324, while EL illuminated actuator plane 312 and EL lamp elements 336, 340, 342, and 344 are formed as a substantially convex surface. Additionally, serpentine spring member 322 may be eliminated as it becomes redundant for this construction. This alternate construction provides a satisfying tactile "snap" when mechanical force is applied to encapsulation layer 346 at a point approximating the centerline of switch shunt 320.

Figure 9:
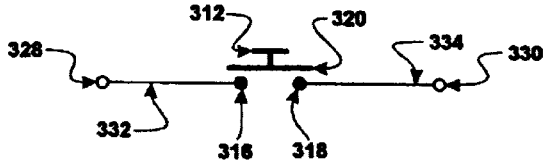
FIG. 9 is a schematic diagram of an equivalent circuit of electroluminescent illuminated membrane switch 300 of FIG. 7.

FIG. 9 is an electrical schematic diagram of the various elements of preferred embodiment 300. When mechanical force is applied to EL illuminated actuator plane 312, shunt 320 bridges contacts 316 and 318. Electrical current path is then made beginning at terminal 328, carried by distribution element 332 to contact 316, bridging through shunt 320 to contact 318, carried by distribution element 334 to terminal 330. In a separate portion of this schematic diagram, alternating current (AC) 356 is applied to electrical terminations 348 and 350. Current flow from electrical termination 350 is carried by distribution element 354 to rear capacitive plate 336. Oppositional AC current 356 is applied to electrical contact 348, carried by distribution element 352 to front capacitive electrode power distribution bus 338, and thence to light transmissive front capacitive plate 344. Capacitive dielectric layer 340 isolates electroluminescent phosphor 342 and, together these layers form a light emitting capacitor dielectric.

This isolated construction method allows the electroluminescent lamp portion to be independently addressed relative to the switch functions. However, by series connection of the switch portion with the electroluminescent lamp portion and to the AC power source 356, successful switch contact actuation may be confirmed by concurrent EL lamp illumination.

Figure 10A:
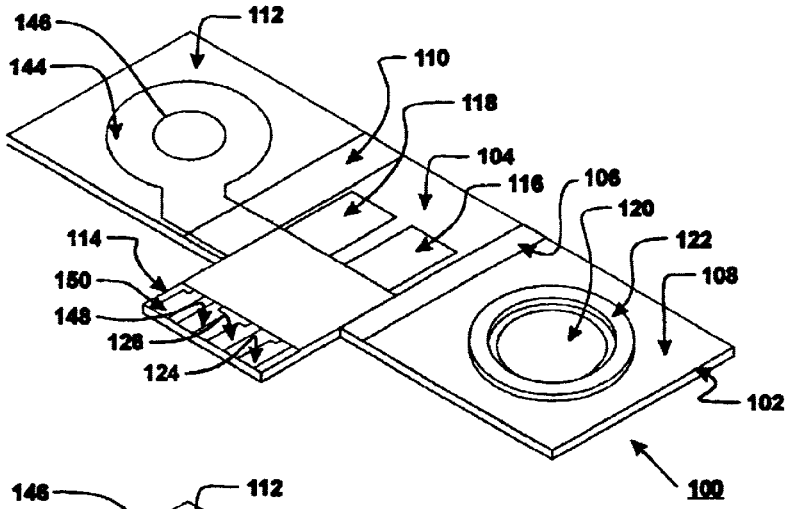
FIGS. 10(*a*) & (*b*) are isometric views of the process subassembly of electroluminescent illuminated membrane switch 100, showing alternative electrical termination locations.
Figure 10B:
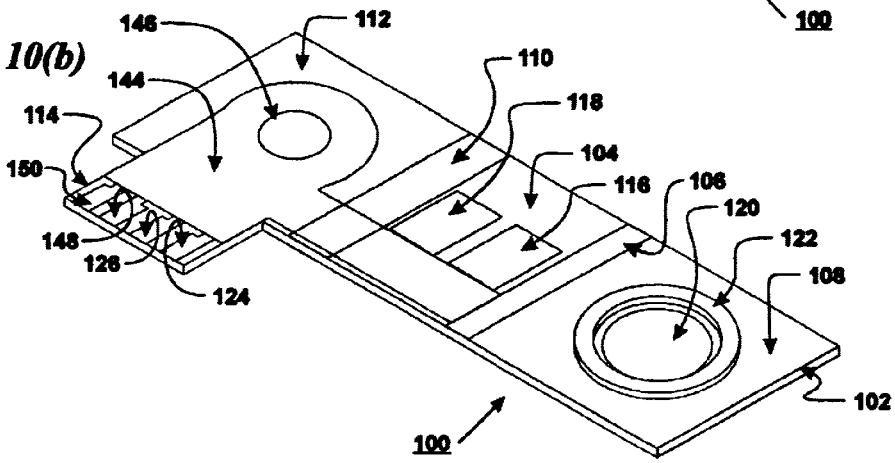

FIG. 10(*a*) is an isometric view of the subassembly manufacturing process plane of first exemplary EL illuminated switch 100, constructed in accordance with the method of FIG. 1. Herein, connector tab 114 extending from stationary switch contact plane 104, and supporting electrical connection terminals 124, 126, 148 and 150, is shown in a position that approximates the centerline between switch contacts 116 and 118.

FIG. 10(*b*) is an isometric view of the subassembly manufacturing process plane of first exemplary EL illuminated switch 100, constructed in accordance with the method of FIG. 1. Herein, connector tab 114 extending from EL illuminated actuator plane 112, and supporting electrical connection terminals 124, 126, 148 and 150, is shown in a position that approximates the centerline of actuator 146.

Figure 11A:
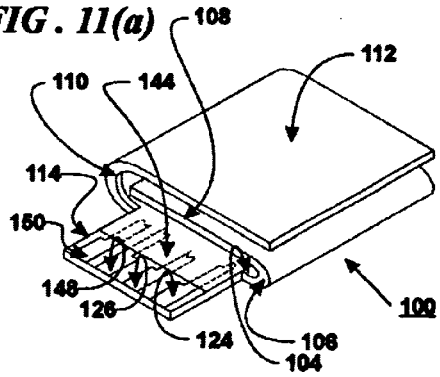
FIGS. 11(*a*) & (*b*) are isometric views of electroluminescent illuminated membrane switch 100 in folded form, showing alternative electrical termination locations.
Figure 11B:
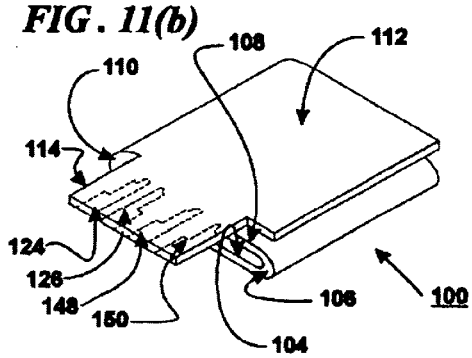

FIG. 11(*a*) illustrates an isometric view of first exemplary EL illuminated switch 100, constructed in accordance with the method of FIG. 10(*a*) in the completed assembly folded condition. Herein, connector tab 114 extending from stationary switch contact plane 104, and supporting electrical connection terminals 124, 126, 148 and 150, is shown whereby electrical connection terminals 124, 126, 148 and 150 are facing toward the EL illuminated actuating plane 112.

FIG. 11(*b*) illustrates an isometric view of first exemplary EL illuminated switch 100, constructed in accordance with the method of FIG. 10(*b*) in the completed assembly folded condition. Herein, connector tab 114 extending from EL illuminated actuator plane 112, and supporting electrical connection terminals 124, 126, 148 and 150, is shown whereby electrical connection terminals 124, 126, 148 and 150 are facing toward the stationary switch contact plane 104.

Together, FIGS. 10(*a*) & (*b*) and 11(*a*) & (*b*) demonstrate the reversibility of electrical connection terminal planes, facilitating the utility of the invention in various electrical and electronic illuminated membrane switch applications.

Figure 12:
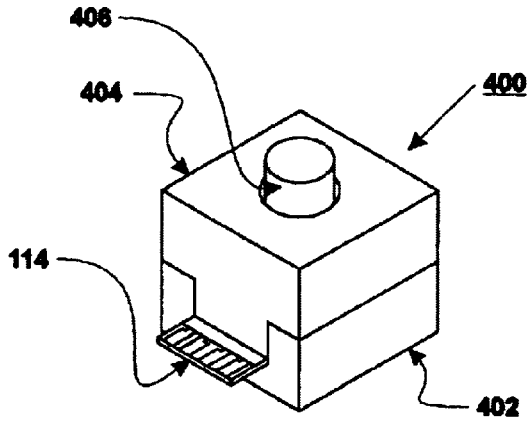
FIG. 12 is an isometric view of an electroluminescent illuminated membrane switch 100 installed inside of a keypad switch enclosure assembly 400.

FIG. 12 illustrates an isometric view of first exemplary EL illuminated switch 100, constructed in accordance with the method of FIG. 1 installed within a housing, creating an illuminated keypad switch 400 with connector tab 114 protruding from a side. Keypad switch 400 consists of a lower housing 402, an upper housing 404 and a light transmissive actuator key 406. Although keypad switch 400 as illustrated herein is a cube shape for clarity, any shape convenient to an end use may be made within the scope of the present invention. Further, although the light transmissive actuator key 406 is illustrated as a cylindrical shape, any shape convenient to end use function may be employed. Such shapes may include, but not be limited to geometric forms; characters; letters; numerals; or indicia.

Figure 13:
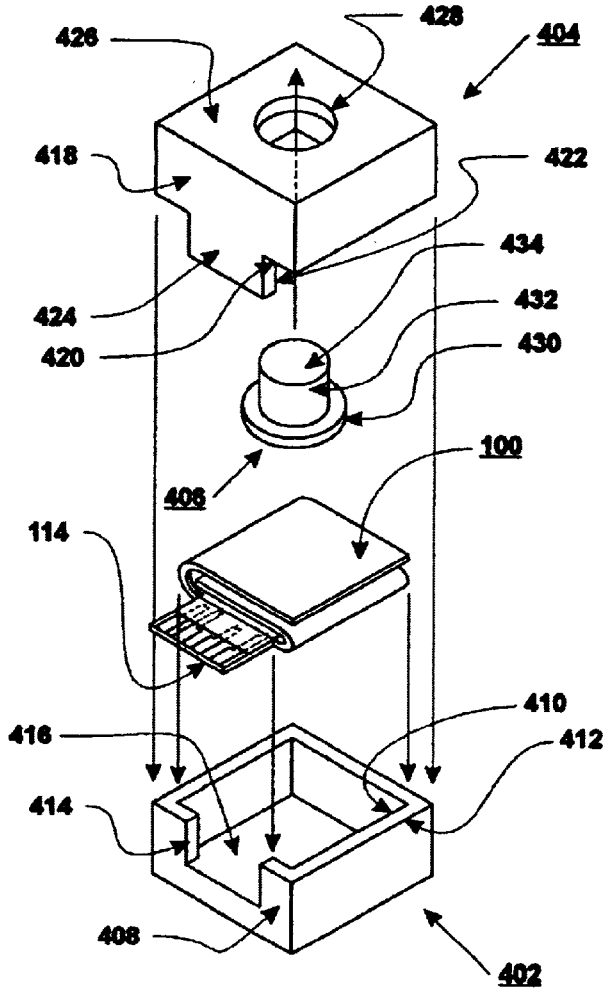
FIG. 13 is an isometric blow-apart view of keypad switch enclosure assembly 400 of FIG. 12.

FIG. 13 is an isometric blow-apart view of keypad switch 400, illustrating the individual components that comprise the completed switch assembly. Lower housing 402 consists of walls 408 that are approximately perpendicular to switch support surface 416, walls 408 having interior surfaces 410 and exterior surfaces 412, and an opening 414 corresponding in size to connector tab 114 of EL illuminated membrane switch 100. Interior surfaces 410 are approximately perpendicular to switch support surface 416, and together these elements create a cavity that intersects opening 414.

Upper housing 404 consists of walls 418 that are approximately perpendicular to keypad actuator support surface 426, walls 418 having interior surfaces 422 and exterior surfaces 420, and a tab 424 that extends planar to walls 418. Tab 424 corresponds in size to opening 414 of lower housing 402, and is of an engaging length equal to the depth of lower housing 402 walls 408 less the thickness of switch 100 connector tab 114, compressively locking connector tab 114 against switch support surface 416. Interior surfaces 422 are approximately perpendicular to keypad actuator support surface 426, and together these elements create an interior cavity with an aperture 428 for access of key 406.

Continuing with FIG. 13, light transmissive key 406 is comprised of a flange portion 430 that rests upon the illuminated surface of switch 100, and shaft 432 rising approximately perpendicularly from flange 430, then terminating in surface 434. The combined length of key 406 is such that shaft 432 protrudes through aperture 428 in order that mechanical pressure applied to surface 434 is transferred to flange 430 thus actuating switch 100. When applied mechanical pressure is released from surface 434, key 406 returns to its original position as a result of stored spring force in switch 100.

Surface 434 may be planar, textured, hemi-spherically domed, printed, painted or otherwise decorated with characters, numerals, indicia, etc. Additionally, shaft 432 and aperture 428 may be correspondingly shaped as polygons, numerals, indicia, etc. to provide uniqueness of application.

Again referring to FIG. 13, the open terminating edges of walls 408 and 418 are permanently mated together, confining key 406 and switch 100 within the cavity formed by walls 408 and 418, support surface 416 and keypad actuator support surface 426. This then completes the assembly of illuminated keypad switch 400. Thus, the method of the present invention provides an automated means to manufacture high volumes of electroluminescent illuminated membrane switches at minimal labor cost, and minimal constituent raw material wastage. Additionally, EL illuminated membrane switches produced by the method of the present invention consume low power, and generate little waste heat. Further, the EL illuminated membrane switches produced by the method of the present invention are significantly more robust than those of conventional manufacture, and may be connected to power sources and other controlling electrical circuitry via processes typically reserved for ordinary flexible printed circuit board products.

The forgoing description includes what are at present considered to be preferred embodiments of the invention. However, it will be readily apparent to those skilled in the art that various changes and modifications may be made to the embodiments without departing from the spirit and scope of the invention. Accordingly, it is intended that such changes and modifications fall within the scope of the invention, and that the invention be limited only by the following claims.

What is claimed is:

1. A method for manufacturing an electroluminescent lamp and membrane switch assembly, said method comprising the following steps of:

forming capacitive electrodes from a metal foil by embossing said metal foil onto a light transmissive insulating flexible plastic film;

forming electrical distribution pathways connected to said capacitive electrodes from a metal foil by embossing said metal foil onto said light transmissive insulating flexible plastic film;

forming electrical terminations that connect to said electrical distribution pathways from a metal foil by embossing said metal foil onto said light transmissive insulating flexible plastic film;

forming a pair of switch contact electrodes from a metal foil by embossing said metal foil onto said light transmissive insulating flexible plastic film;

forming electrical distribution pathways connected to said pair of switch contact electrodes from a metal foil by embossing said metal foil onto said light transmissive insulating flexible plastic film;

forming electrical terminations that connect to said electrical distribution pathways from a metal foil by embossing said metal foil onto said light transmissive insulating flexible plastic film;

forming a switch contact shunt electrode from a metal foil by embossing said metal foil onto said light transmissive insulating flexible plastic film;

applying said light transmissive insulating flexible plastic film to an optically registered indexing system, said optically registered indexing system to precisely position said light transmissive insulating plastic film for further electroluminescent lighted membrane switch construction processing;

applying a light transmissive electrically conductive layer to said light transmissive insulating plastic film, said light transmissive electrically conductive layer contacting one said capacitive electrode thereby creating a light transmissive first capacitive plate;

applying a layer of electroluminescent phosphor to said light transmissive electrically conductive layer, said electroluminescent phosphor layer for precisely defining an area of illumination;

applying a layer of capacitive dielectric to said metal foil capacitive electrode, said capacitive dielectric for electrically isolating said electroluminescent phosphor layer;

applying a conductive layer to said capacitive dielectric layer, said conductive layer contacting said opposite capacitive electrode thereby creating a second capacitive plate;

applying an insulating layer to cover said second capacitive plate, said insulating layer extending to cover said electrical distribution pathways;

applying an insulating spacer surrounding said switch contact shunt electrode, said insulating spacer substantially forming a frame element that is offset from the perimeter of switch contact shunt electrode;

applying a second insulating layer onto said first insulating layer substantially centered over said second capacitive plate and of a shape and size to approximate the shape and size of said switch contact shunt electrode, said second insulating layer substantially forming a convex outer surface;

die cutting said light transmissive insulating flexible plastic film in a pattern comprising a three part, two hinged foldable electroluminescent illuminated membrane switch subassembly having a tab portion extending therefrom, said tab portion supporting said electrical terminations connecting to said electrical distribution pathways, thus creating an electroluminescent illuminated membrane switch subassembly;

folding a first portion from said electroluminescent illuminated membrane switch subassembly, said first portion folded at the location of one of two said hinges and substantially positioning said switch contact shunt electrode opposite switch contact electrodes; and folding a second portion from said electroluminescent illuminated membrane switch subassembly, said second portion folded at the location of the remaining said hinge and substantially positioning said second insulating layer opposite said switch contact shunt electrode.

2. The method of claim 1 wherein said metal foil is die cut to form said capacitive electrodes.

3. The method of claim 1 wherein said metal foil is chemically etched to form said capacitive electrodes.

4. The method of claim 1 wherein said metal foil is laser cut to form said capacitive electrodes.

5. The method of claim 1 wherein said capacitive electrodes is a layer of electrically conductive ink.

6. The method of claim 1 wherein said capacitive electrodes is a layer of deposited metal.

7. The method of claim 1 wherein said metal foil is die cut to form said electrical distribution pathways.

8. The method of claim 1 wherein said metal foil is chemically etched to form said electrical distribution pathways.

9. The method of claim 1 wherein said metal foil is laser cut to form said electrical distribution pathways.

10. The method of claim 1 wherein said electrical distribution pathways is a layer of electrically conductive ink.

11. The method of claim 1 wherein said electrical distribution pathways is a layer of deposited metal.

12. The method of claim 1 wherein said metal foil is die cut to form said electrical terminations.

13. The method of claim 1 wherein said metal foil is chemically etched to form said electrical terminations.

14. The method of claim 1 wherein said metal foil is laser cut to form said electrical terminations.

15. The method of claim 1 wherein said electrical terminations is a layer of electrically conductive ink.

16. The method of claim 1 wherein said electrical terminations is a layer of deposited metal.

17. The method of claim 1 wherein said metal foil is die cut to form said pair of switch contact electrodes.

18. The method of claim 1 wherein said metal foil is chemically etched to form said pair of switch contact electrodes.

19. The method of claim 1 wherein said pair of switch contact electrodes is a layer of electrically conductive ink.

20. The method of claim 1 wherein said metal foil is laser cut to form said pair of switch contact electrodes.

21. The method of claim 1 wherein said metal foil is die cut to form said switch contact shunt electrode.

22. The method of claim 1 wherein said metal foil is chemically etched to form said switch contact shunt electrode.

23. The method of claim 1 wherein said switch contact shunt electrode is a layer of electrically conductive ink.

24. The method of claim 1 wherein said metal foil is laser cut to form said switch contact shunt electrode.

25. The method of claim 1 wherein said switch contact shunt electrode is embossed to form a substantially convex snap dome contact.

26. The method of claim 1 wherein said light transmissive first capacitive plate is a layer of conductive ink.

27. The method of claim 1 wherein said light transmissive first capacitive electrode layer is a conductive metal oxide coated plastic film.

28. The method of claim 1 wherein said light transmissive first capacitive electrode layer is a conductive ink containing metal oxide.

29. The method of claim 1 wherein said light transmissive first capacitive electrode is a sputter coated layer containing metal oxide.

30. The method of claim 1 wherein said light transmissive first capacitive electrode is a plasma spray coated metal oxide.

31. The method of claim 1 wherein said light transmissive first capacitive electrode is a conductive organic polymer comprised of PEDOT (Poly3,4-Ethyelenedioxithiophene).

32. The method of claim 1 wherein said electroluminescent phosphor layer is an electroluminescent phosphor particle imbued plastic film.

33. The method of claim 1 wherein said electroluminescent phosphor layer is an electroluminescent phosphor particle imbued ink.

34. The method of claim 1 wherein said electroluminescent phosphor layer is applied via plasma spray.

35. The method of claim 1 wherein said capacitive dielectric layer is a plastic film.

36. The method of claim 1 wherein said capacitive dielectric layer is an ink.

37. The method of claim 1 wherein said capacitive dielectric layer is applied via plasma spray.

38. The method of claim 1 wherein said second capacitive plate is an ink.

39. The method of claim 1 wherein said second capacitive plate is a metal foil.

40. The method of claim 1 wherein said second capacitive plate is a plated metal.

41. The method of claim 1 wherein said second capacitive plate is metal applied via plasma spray.

42. The method of claim 1 wherein said second capacitive plate is a plated metal plastic film.

43. The method of claim 1 wherein said second capacitive plate is a conductive organic polymer comprised of PEDOT (Poly-3,4-Ethyelenedioxithiophene).

44. The method of claim 1 wherein said insulating spacer surrounding said switch contact shunt electrode is printable elastomeric ink.

45. The method of claim 1 wherein said insulating spacer surrounding said switch contact shunt electrode is an adhesive.

46. The method of claim 1 wherein said insulating spacer surrounding said switch contact shunt electrode is an adhesively mounted plastic form.

47. The method of claim 1 wherein said insulating spacer surrounding said switch contact shunt electrode is an embossed serpentine spring member.

48. The method of claim 1 wherein said second insulating layer is printable elastomeric ink.

49. The method of claim 1 wherein said second insulating layer is an adhesive.

50. The method of claim 1 wherein said second insulating layer is an adhesively mounted plastic form.

* * * * *